United States Patent [19]

Sevastakis

[11] 4,291,747

[45] Sep. 29, 1981

[54] COOLER FOR TWIN STRAND CONTINUOUS CASTING

[76] Inventor: Gus Sevastakis, 5645 Angola Rd., Toledo, Ohio 43615

[21] Appl. No.: 89,856

[22] Filed: Oct. 31, 1979

[51] Int. Cl.[3] ..... B22D 11/10; B22D 11/00

[52] U.S. Cl. ..... 164/420; 164/348; 164/443

[58] Field of Search ..... 164/82, 89, 443, 348, 164/444, 420

[56] References Cited

U.S. PATENT DOCUMENTS

| | | | |
|---|---|---|---|
| 1,785,941 | 12/1930 | Eppensteiner | 164/348 X |
| 2,176,990 | 10/1939 | Crampton | 164/443 X |
| 3,730,257 | 5/1973 | Klaussner | 164/443 |

FOREIGN PATENT DOCUMENTS

| | | | |
|---|---|---|---|
| 201250 | 6/1958 | Austria | 164/443 |
| 532310 | 10/1956 | Canada | 164/89 |
| 838383 | 8/1971 | Canada | 164/443 |

*Primary Examiner*—R. L. Spruill
*Assistant Examiner*—Gus T. Hampilos
*Attorney, Agent, or Firm*—William E. Mouzavires

[57] ABSTRACT

For use in a twin strand continuous vertical casting operation, a cooler including a steel jacket surrounding a cooling member having a pair of die receiving passages for respectively receiving the dies utilized to form the twin strand or products. Coolant introduced into the jacket is not only circulated about the periphery of the cooling member but also is circulated diametrically through the cooling member itself in the area between the die receiving passages. In one preferred form, two pairs of inlet and outlet ports are provided in the jacket for circulating fluid around and through the cooling member in separate independent paths governed by the shape of the cooling member and a partition within the jacket.

25 Claims, 6 Drawing Figures

COOLER FOR TWIN STRAND CONTINUOUS CASTING

RELATED APPLICATIONS

The present application is in part related to my prior pending U.S. applications, one being Ser. No. 974,317, filed Dec. 29, 1978, and the other being Ser. No. 06/090,049 filed concurrently herewith entitled "Improvements In Continuous Vertical Casting".

BACKGROUND OF INVENTION

In "twin strand" continuous, vertical, casting, a pair of elongated bar products are simultaneously formed through means of two forming dies into which molten metal is poured from a crucible and from which metallic bar products, either solid or hollow, are formed in accordance with the internal shape of the dies and in some cases, where hollow products are formed, the shape of an internal mandrel. Because of the excessively high temperatures of the molten metal, coolers are employed to cool the dies as well as the products being formed; these coolers being of the type which circulate a coolant such as water in a jacket surrounding a cooling sleeve or cooling member which receives the forming die.

In commercial continuous vertical casting operations, it is very important that the cooling of the forming dies as well as the cast products not only be achieved in accordance with a desired production rate but furthermore, that the cooling be effective and uniform. The objective here is to obtain not only a high rate of production suitable for commercial production, but furthermore to obtain a bar product of uniform strength and grain appearance. In addition, it is the objective to prolong the life of the forming dies as well as the parts of the cooler itself because if any of these members become ruptured or broken, it necessitates stoppage of production and replacement of the parts which is very expensive.

OBJECTS OF INVENTION

It is an object of the present invention to provide an improved cooler for a twin strand continuous casting operation, and although the invention is particularly suitable for vertical continuous casting operations, it may also be applied to horizontal continuous casting operations. Included herein is such a cooler that will effectively cool the forming dies and the bar products being cast but also parts of the cooler itself.

Another object of the present invention is to provide such a cooler which will produce uniform cooling of the forming dies and consequently uniform cooling of the bar products being cast.

Another object of the present invention is to provide such a cooler as stated which will obtain the above objects and yet may be utilized in commercial casting operations where certain production rates must be met. Included herein is such a cooler which may be economically manufactured and utilized with conventional commercial casting apparatus.

SUMMARY OF THE INVENTION

In summary, the cooler of the present invention includes a jacket and a cooling member within the jacket having a body including a pair of die-receiving passages for receiving the forming dies of a twin strand casting operation. In accordance with the present invention, coolant introduced into the jacket is circulated not only about the peripheral surface of the cooling member but also through coolant passages in the cooling member in the area between the die-receiving passages to thus ensure that the cooling member and, in turn, the forming dies will be uniformly and effectively cooled.

In one preferred form of the invention, two separate pairs of coolant inlet and outlet ports are provided in the jacket, two independent sets of coolant passages are provided through the cooling member, and the space between the cooling member and the jacket is partitioned so as to establish two separate and independent cooling systems, one for each of the forming dies. In this way, the amount or rate of coolant for each system can be varied independently of the other system depending on the heat condition of the associated forming die or products being cast during an actual operation. Other improvements are incorporated in the cooler, such improvements also being incorporated in the subjects of my prior pending U.S. applications identified above.

DRAWINGS

Other objects and advantages of the present invention will become apparent from the following more detailed description of the present invention in conjunction with the attached drawings in which.

DETAILED DESCRIPTION

Figure 1:
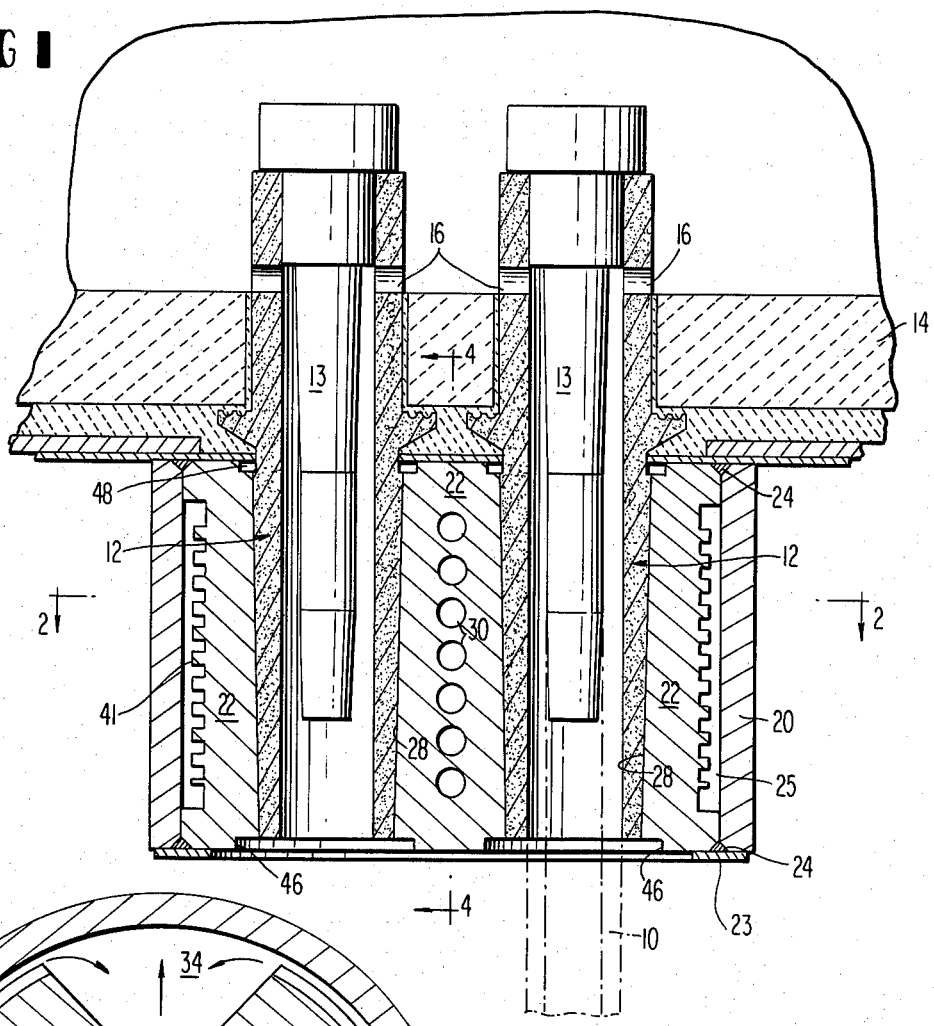
FIG. 1 is an elevational cross-sectional view of a cooler constituting a first embodiment of the present invention shown installed about a pair of forming dies of a twin strand continuous casting operation, with portions of the associated crucible shown in fragment.

Referring now to the drawings in detail, there is shown in FIG. 1 for illustrative purposes only, a twin strand continuous vertical casting apparatus for producing twin bars generally designated 10 (only one shown), the apparatus incorporating a cooler constituting one embodiment of the present invention. Twin bars 10 are formed from vertical dies 12 typically made from graphite. Bars 10 may either be solid bars or hollow bars 10 shown but in the event of the latter, mandrels 13 are utilized within the dies 12 in order to form the hollow of the bars. Bars 10 are formed from a metal such as bronze which is introduced into the dies 12 in molten form from a crucible 14 in well-known manner. The upper portions of dies 12 are provided with ports 16 through which the molten metal passes from the crucible into the die. While in the die, the molten metal begins to solidify and the bar products emerge from the bottom of the dies 12 as indicated in the drawings. Thus, in a twin strand operation, two bars 10 are simultaneously formed in one continuous operation although it should be recognized that only one bar 10 is shown in FIG. 1 for purposes of brevity.

In order to cool the dies 12 and consequently the products 10 during a casting operation, a cooler is utilized about the dies 12; the cooler resting on a suitable horizontal support structure 23. The cooler includes a jacket 20 which may have a generally cylindrical configuration, and a cooling member generally designated 22 received in the jacket and fixed to the jacket in the preferred manufacture by means of annular welds 24 at the upper and lower ends of the jacket and the cooling member. The cooling member 22 is dimensioned so as to leave a space 25 between the peripheral surface of the cooling member and the surrounding jacket 20 for circulating a coolant such as water as will be described in greater detail.

Dies 12 are received in the cooling member 22 by means of die passages 28 which are laterally spaced from each other and extend in a vertical direction along axes which are generally parallel to each other. The surfaces of die passages 28 are tapered to correspond to matching tapers formed on the outside surface of the dies 12 so that the dies will be seated throughout in continuous, intimate, contact with the cooling member 22 to enhance heat transfer while securely positioning the dies.

Figure 2:
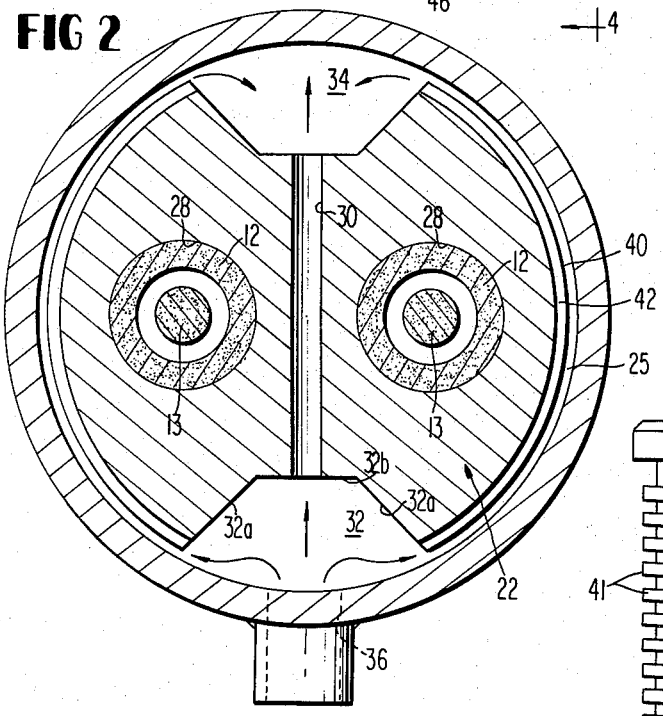
FIG. 2 is a cross-sectional view taken generally along lines 2—2 of FIG. 1 and also showing arrows representing the path of flow of coolant.
Figure 3:
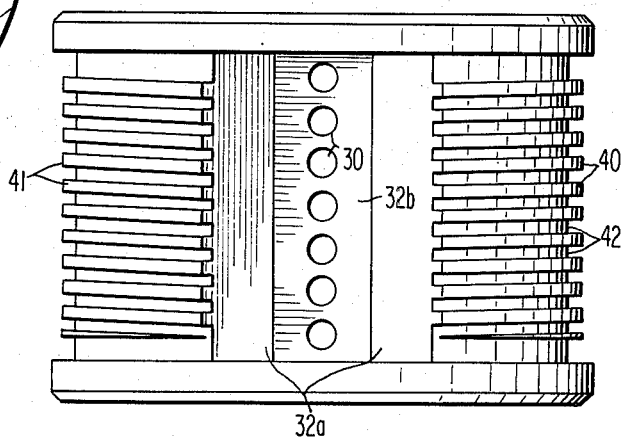
FIG. 3 is an elevational view of a cooling member included in the cooler of FIG. 1.
Figure 4:
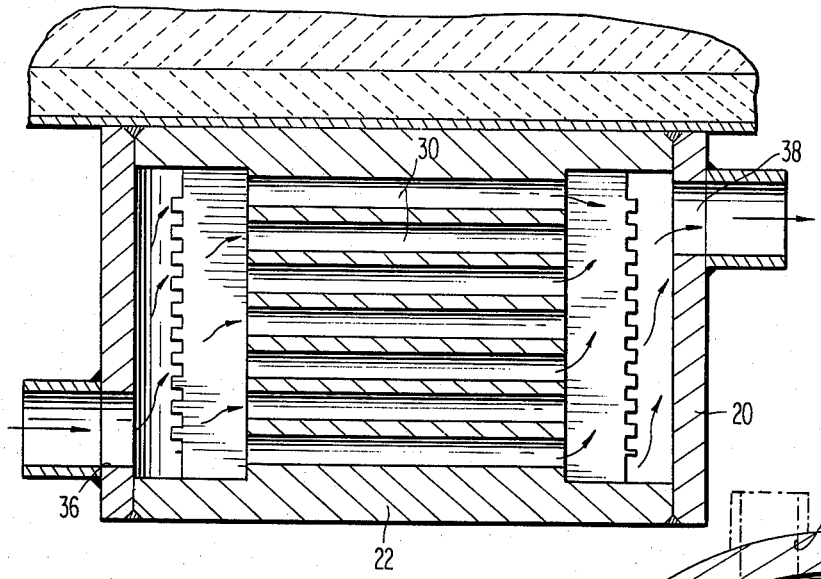
FIG. 4 is a cross-sectional view taken generally along lines 4—4 of FIG. 1.

In accordance with the present invention, a plurality of coolant passages 30 are formed through the cooling member 22 in the region between the die passages 28. In the specific embodiment shown, coolant passages 30 have a generally cylindrical shape as shown in FIG. 1 and each extends along a diametrical line through the cooling member 22 as shown in FIG. 2. In addition, coolant passages 30 are vertically spaced from each other in parallel, one below the other in direct line substantially throughout the depth of cooling member 22 as shown in FIGS. 1, 3 and 4.

In addition, it is preferred that opposite side portions of cooling member 22 adjacent cooling passages 30 be recessed. In the specific form shown, these recesses 32, 34 are diametrically opposed and each has a generally V-shape, including opposite side walls 32*a* converging inwardly of the cooling member and a bottom wall 32*b* extending in chordal fashion between side walls 32*a* as shown in FIGS. 2 and 3. The length of recesses 32, 34 in the vertical direction of the cooling member corresponds to the vertical height of the cooling member or the distance between the uppermost and lowermost coolant passages 30 so that coolant will flow through all of the coolant passages 30 as will be described.

A suitable coolant which, as indicated, may be water, is introduced into the jacket and the recess 32 by means of an inlet port 36 formed in the bottom of the jacket in registry with recess 32 as shown in FIG. 2. As indicated by the arrows in FIG. 2, the coolant will then circulate in three different directions from inlet recess 32; one direction being clockwise about the periphery of the cooling member 22 in the space 25, the other direction being counterclockwise about the periphery of the cooling member 22 in the space 25, and the third direction being diametrically through the cooling member 22 itself through the cooling passages 30 and then into recesses 34. Coolant will flow into recess 34 from two directions from the peripheral space 25 between the cooling member 22 and the jacket 20. The coolant will be discharged from the jacket from recess 34 through an outlet port 38 formed in the top end of the jacket as shown in FIG. 4. In order to ensure that the volume of flow in the three different directions described above will be equal or substantially equal, the total cross-sectional area of the coolant passages 30 is made approximately equal to one-third of the cross-sectional area of the inlet port 36. In addition, outlet port 38 is made with a cross-sectional area at least as great as inlet port 36.

It will thus be seen from the above described flow path of the coolant about and through the cooling member 22, that the inwardly positioned or internal portions of the dies 12 will be subjected to coolant as well as the outwardly positioned or external portions thereof. In this way, uniform and enhanced cooling is brought to the dies 12 and consequently the bars 10.

In order to enhance cooling of the cooling member 22, the outer surface thereof is formed with a plurality of annular or arcuate ridges 40, 41 which define flow paths 42 of U-shape cross sections between the ridges. These ridges 40, 41 and flow paths 42 increase the surface contact of the coolant with the cooling member 22 and, at the same time, serve to direct the flow of the coolant about the periphery of the coolant member in the proper ascending direction. In addition, it is preferred that ridges 40 on one side of the cooling member be formed to extend along a helical path which ascends from the bottom of the cooling member towards the top of the cooling member; it being understood that the inlet port 36 is located in the bottom of the cooling jacket as described above. Likewise it is preferred that the ridges 41 on the opposite side of the cooling member 22 be formed along a helical path which ascends from the bottom of the cooling member towards the top of the cooling member. Naturally, these helical paths will be different from each other since both ascend upwardly from the bottom of the cooling member 22. Although helical ridges 40 and 41 are preferred, other types of annular ridges may be employed instead, such as those which extend about separate circular paths to provide annular concentric rings. It is also preferred that the opposite ends of each of the die passages 28 be provided with annular recesses 46, 48 (FIG. 1) for reducing the amount of heat which is conveyed to the cooling member at its welds 24 and at its portions which immediately surround the dies 12. A more detailed description of the functioning and advantages of ridges 40, 41 and recesses 46, 48 may be obtained from my pending U.S. Application Ser. No. 06/090,049 having been filed concurrently herewith.

Figure 5:
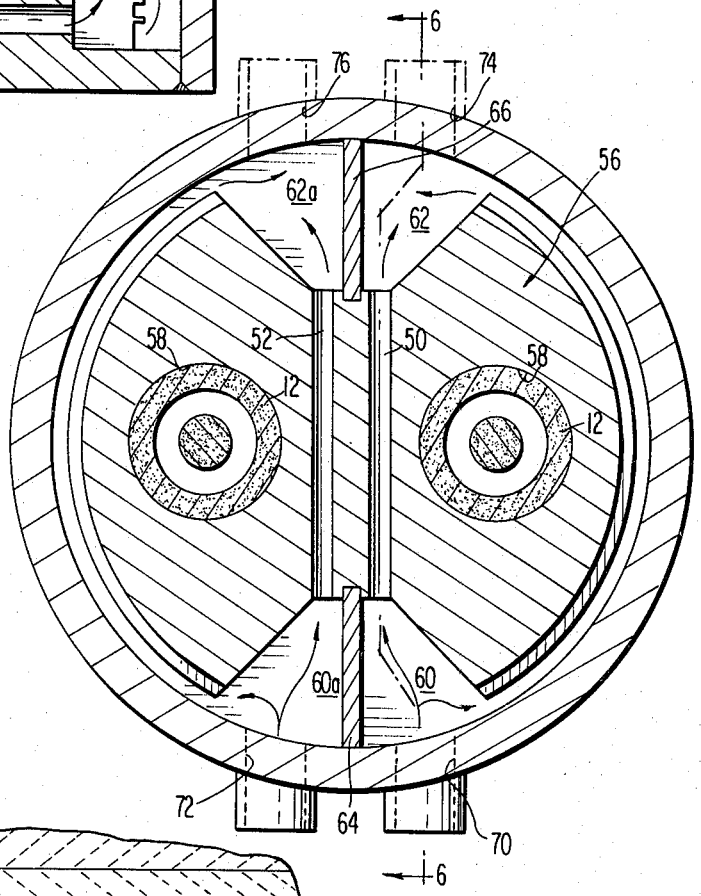
FIG. 5 is a cross-sectional view generally similar to FIG. 2 but of a cooler constituting a second and preferred embodiment of the present invention.
Figure 6:
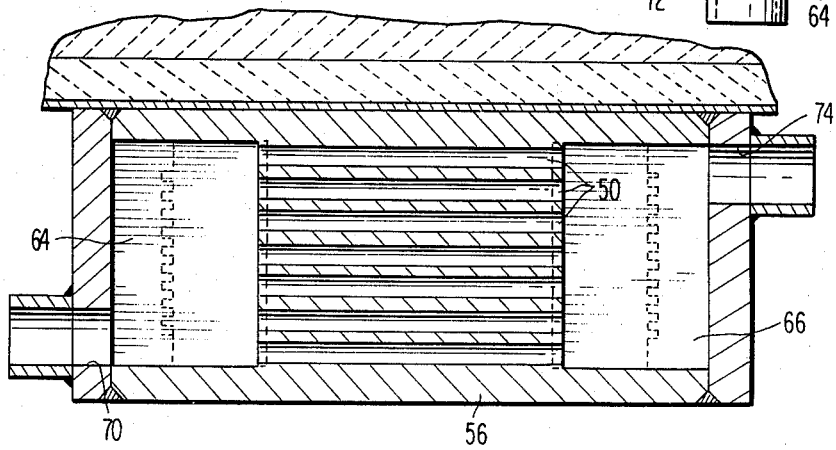
FIG. 6 is a cross-sectional view taken generally along lines 6—6 of FIG. 5.

Referring now to FIGS. 5 and 6, there is shown a preferred embodiment of the present invention wherein two sets of coolant passages 50 and 52 are formed through the cooling member 56 in the region between the die passages 58. The coolant passages 50 and 52 in each set are vertically spaced from each other throughout the depth of the cooling member 56 similar to that in the embodiment of FIG. 1. A pair of recesses are provided in each of the opposite side portions of cooling member 56 throughout its vertical dimension so as to communicate with the sets of coolant passages 50 and 52 respectively. In the preferred embodiment shown, the coolant passages 50 of one set are separated from the coolant passages 52 of the other set by partitions generally designated 64, 66 which extend from the inner surface of the jacket to the bottom walls of the recesses in the area between the coolant passages 50, 52. Partitions 64, 66 in effect form two pairs of recesses or chambers on each side of the cooling member 56. Thus, one pair is designated 60, 60*a* and the other pair on the opposite side of cooling member 56 is 62, 62*a*. Recesses 60 and 62 communicate with flow passages 50, while recesses 60*a* and 62*a* communicate with flow passages 52.

In addition, in the preferred embodiment presently being described, two pairs of inlet and outlet ports are provided one for communicating with the coolant passages 50 on one side of partitions 64, 66 and the other for communicating with coolant passages 52 on the opposite side of partitions 64, 66. Thus, inlet port 70 is provided in the lower end portion of the jacket to communicate with recess 60 as shown in FIG. 5, while another inlet port 72 is provided in the lower portion of the jacket to communicate with the recess 60*a*. At the top of the jacket on the side opposite inlet ports 70, 72, a first outlet port 74 is provided to communicate with recess 62, and another inlet port 76 is provided to communicate with the recess 62*a*.

It should be seen from the above that coolant entering recess 60 from inlet port 70 will flow through coolant passages 50 into recess 62 on the opposite side of the jacket and discharge from outlet port 74. In addition, coolant entering inlet port 70 and recess 60 will flow about the periphery of the cooling member 56 in the space between the latter and the jacket and then into recess 62 where it will be discharged through outlet port 74.

Coolant entering the jacket from the other inlet port 72 will be totally isolated by partition 64 from the coolant which enters through inlet port 70 and will flow into the lefthand recess 62*a* through the other set of coolant passages 52 and about the periphery of the cooling member 56. This coolant will, after entering recess 62*a*, discharge through outlet port 76 while being isolated from the coolant in recess 62 by partition 66.

Since in the preferred embodiment just described, the coolant entering each of the recesses 60 and 60*a* divides into two paths, one being through the associated coolant passages 50 or 52 and the other being about the periphery of the cooling member 56, it is preferred that the total cross section of the cooling passage in each set 50, 52 have an area approximately one-half the area of the associated inlet port 70, 72. Outlet ports 74, 76 are made with cross-sectional areas at least as great as their associated inlet ports 70, 72.

In other respects, the cooling member 56 in the preferred embodiment may be provided with peripheral annular ridges, and recesses about the opposite ends of the die passages 58, as described above in connection with the embodiment of FIG. 1.

It will therefore be seen that the preferred embodiment provides two independent and separate cooling systems, one for each of the dies 12 received in die passages 58. This provides the advantage that the amount of cooling imparted to a single die 12 may be varied to meet an existing condition of the product being cast by that die without changing the amount of coolant imparted to the other die. Thus, during an operation, the rate of flow of coolant or the amount of coolant introduced into the associated cooling system may be increased or decreased to enhance or decrease the cooling of one product 10 without changing the cooling of the other product. This advantage is most important because the speed of casting must be the same for both products and thus cannot be varied in order to vary the cooling of one product without varying the cooling of the other product.

It should be understood that during actual casting operations, it is common for one product of a twin strand to require its rate of cooling to be varied from that of the other even though both products may have the same internal diameter. This can be caused by several factors, for example, when the fit of the die in the cooler is not correct. The present invention is also admirably suited to twin strand operations where the size of the products of the twin strand have different internal diameters (or weights per foot) which would require different cooling rates.

What is claimed is:

1. Twin strand continuous vertical casting apparatus comprising in combination; a jacket, a cooling member having a body of heating conducting material located in the jacket and having internal walls defining a pair of vertical laterally spaced die passages extending generally along parallel axes for receiving bar-forming dies in intimate contacting relationship, a pair of bar-forming dies respectively received in said die passages in intimate relationship with the internal walls defining said passages, a first inlet port through the jacket for introducing a coolant into the jacket to contact the body, a first outlet port through the jacket for discharging coolant from the jacket, a coolant flow passage extending through the body between said pair of vertical die passages for circulating coolant through the body, said body of the cooling member having an outer surface including annular ridges extending about and along the body in helical fashion while being spaced from the jacket to define a plurality of coolant flow channels between the body and the jacket and said coolant flow passage communicating with said coolant flow channels defined by said annular ridges.

2. The apparatus defined in claim 1 wherein said body of the cooling member has opposite end surfaces surrounding the dies and defining vacant recesses between the body and the dies for reducing heat transfer through the body.

3. A cooler for use in a twin strand continuous vertical casting apparatus comprising, a jacket, a cooling member having a body of heating conducting material located in the jacket and having internal walls defining a pair of vertical laterally spaced die passages extending generally along parallel axes for receiving bar-forming dies in intimate contacting relationship, a first inlet port through the jacket for introducing a coolant into the jacket to contact the body, a first outlet port through the jacket for discharging coolant from the jacket, and at least one coolant flow passage extending through the body between said pair of vertical die passages for circulating coolant through the body, the body of the cooling member having an outer surface, said die passages having vertical axes, and the outer surface of said body having a plurality of generally annularly extending ridges spaced along an axis which extends generally parallel to said axes of said die passages defining annular coolant chemicals, said at least one coolant flow passage communicating with said annular coolant channels.

4. The cooler defined in claim 3 wherein said body has opposite side portions, and said flow passage extends from one side portion to another side portion of said body.

5. The cooler defined in claim 4 wherein said side portions of the body define recesses communicating with said coolant flow passages.

6. The cooler defined in claim 5 wherein the body of the cooling member has a vertical axis, and there is included a plurality of said flow passages extending through said body and communicating with said recesses, said flow passages being spaced from each other along the direction of the vertical axis of the body.

7. The cooler defined in claim 6 wherein said inlet and outlet ports are located adjacent said recessed in said body.

8. The cooler defined in claim 6 wherein the total cross-sectional area of said flow passages is approximately equal to one-third of the cross-sectional area of said inlet port.

9. The cooler defined in claim 5 wherein said recesses in said body each have a generally V-shape cross-section, and said opposite side portions of the body each includes opposite side walls converging inwardly of said body.

10. The cooler defined in claim 9 wherein said opposite side portions of the body each has a bottom wall extending between said side walls thereof, said flow passages opening into the recesses at said bottom walls thereof.

11. The cooler defined in claim 1 including a second inlet port for introducing coolant into the jacket and a second outlet port for discharging coolant from the jacket.

12. The cooler defined in claim 11 wherein there is further included a plurality of said flow passages extending through said body.

13. The cooler defined in claim 12 wherein there is included a first set of said flow passages communicating with said first inlet and outlet ports and a second set of said flow passages communicating with said second inlet and outlet ports.

14. The cooler defined in claim 13 wherein there is included means separating said first and second sets of flow passages from communication with each other.

15. The cooler defined in claim 14 wherein said first and second sets of flow passages are spaced laterally from each other with the flow passages in each set being vertically spaced from each other and wherein said means for separating said first and second sets of flow passages includes partitions extending between the jacket and the body in regions lying between said first and second sets of flow passages.

16. The cooler defined in claim 15 wherein said first inlet and outlet ports open into the jacket on one side of said partitions and said second inlet and outlet ports open into said jacket on the opposite side of said partitions.

17. The cooler defined in claim 15 wherein said body is provided in opposite sides thereof with recesses and wherein said partitions are respectively located in said recesses.

18. The cooler defined in claim 16 wherein the total cross-sectional area of one of said flow passages is approximately equal to one-half of the cross-sectional area of an associated inlet port.

19. The cooler defined in claim 1 wherein there is included a plurality of said flow passages vertically spaced from each other.

20. The cooler defined in claim 19 wherein said ridges ascend along a helical path.

21. The cooler defined in claim 19 wherein said body has opposite end surfaces each having a pair of vacant recesses respectively located about said die passages for reducing heat transfer through the cooler.

22. For use in a cooler for simultaneously cooling a pair of dies in a twin strand continuous casting operation, a cooling member including a body having internal walls defining a pair of die passages extending parallel to a vertical axis of said body and being laterally spaced from each other for respectively receiving a pair of forming dies, coolant passage means formed through the body between said die passages for directing coolant through internal portions of the body between said die passages, said coolant passage means communicating with coolant flow channels formed in an external surface of said body, said external surface of said body including a plurality of annular ridges defining said plurality of coolant flow channels, said ridges extending along a helical path about and along the external surface of said body.

23. For use in a cooler as defined in claim 22 wherein an internal wall defining said coolant passage means formed through the body are transverse to the direction of said die passages for directing coolant through internal portions of the body between said die passages.

24. For use in a cooler as defined in claim 23 wherein said body has in opposite side portions thereof, a pair of recesses respectively communicating with opposite ends of said coolant passage means.

25. A cooler for use in twin strand continuous vertical casting apparatus comprising, a jacket, a cooling member having a body including a vertical axis and being comprised of heat conducting material, said body of the cooling member being located in the jacket and having internal walls defining a pair of vertical laterally spaced die passages extending along axes generally parallel to each other and to the vertical axis of the body for receiving bar-forming dies in intimate contacting relationship with the body, a first inlet port through the jacket for introducing a coolant into the jacket to contact the body, a first outlet port through the jacket for discharging coolant from the jacket, a plurality of coolant flow passages extending through the body between said pair of die passages for circulating coolant through the body in the region between said vertical die passages, said body of the cooling member further having opposite side portions, said coolant flow passages extending from one side portion to another side portion of said body, said opposite side portions of the body defining recesses communicating with said coolant flow passages, said coolant flow passages being spaced from each other along the direction of the vertical axis of the body, said body having an outer surface including a plurality of generally annularly extending ridges spaced along an axis extending generally parallel to the vertical axis of the body.

* * * * *